US006416394B1

(12) United States Patent
Hacikyan et al.

(10) Patent No.: US 6,416,394 B1
(45) Date of Patent: Jul. 9, 2002

(54) PLANAR/GRINDER FOR GLASS

(75) Inventors: Michael Hacikyan, 100 Meadow Dr., Buffalo, NY (US) 14216; Robert Willer, Grand Island, NY (US)

(73) Assignee: Michael Hacikyan, Buffalo, NY (US)

( * ) Notice: Subject to any disclaimer, the term of this patent is extended or adjusted under 35 U.S.C. 154(b) by 0 days.

(21) Appl. No.: 09/532,251

(22) Filed: Mar. 22, 2000

(51) Int. Cl.[7] ..... B24B 1/00
(52) U.S. Cl. ..... 451/44; 451/41; 451/178
(58) Field of Search ..... 451/41, 44, 178, 451/358, 361, 411; 51/72 R, 102, 270, 322

(56) References Cited

U.S. PATENT DOCUMENTS 2,790,271 A * 4/1957 Samson ..... 451/178
3,123,950 A * 3/1964 Kuris et al. ..... 451/450 X
4,322,915 A 4/1982 Kindig ..... 51/128
4,423,568 A 1/1984 Gould ..... 51/72 R
5,241,791 A * 9/1993 Lacy ..... 51/81 R
5,251,407 A * 10/1993 Afshar ..... 451/358 X
5,345,726 A * 9/1994 Gach ..... 451/177 X
5,409,417 A * 4/1995 Bando ..... 451/44 X
5,549,509 A 8/1996 Hirst et al. ..... 451/178
5,609,512 A 3/1997 Holmes et al. ..... 451/48
6,123,606 A * 9/2000 Hill et al. ..... 451/450 X

* cited by examiner

*Primary Examiner*—Joseph J. Hail, III
*Assistant Examiner*—Anthony Ojini
(74) *Attorney, Agent, or Firm*—Hodgson Russ LLP

(57) ABSTRACT

A planar/grinding apparatus comprising a housing, a cylindrical member and a motor is the present invention. The housing has a first planar working surface at a first elevation, a second planar working surface at a second elevation which is greater than the first elevation, and at least one aperture positioned in the first and second planar working surfaces. The cylindrical member projects through the aperture and has at least two abrasive surfaces thereon. The first abrasive surface extends from a third elevation, at least equal to or below the first elevation, to a fourth elevation, above the first elevation and below the second elevation. The second abrasive surface extends from a fifth elevation, at least equal to or below the second elevation and above the fourth elevation, to the sixth elevation, above the second elevation. While the motor rotates the cylindrical member.

25 Claims, 8 Drawing Sheets

PLANAR/GRINDER FOR GLASS

FIELD OF THE INVENTION

The present invention relates to an apparatus that planes and grinds glass.

BACKGROUND OF THE INVENTION

U.S. Pat. No. 4,322,915 issued to Kindig illustrates an apparatus for beveling glass edges. The beveling occurs when the glass is placed upon a planar surface and contacts a grinder wheel assembly having multiple grinding surfaces (elements 78 and 76) which is driven by a first motor. The multiple grinding surfaces are designed to just bevel the glass as illustrated in FIG. 5 of the '915 patent. Moreover, there is just one planar surface in which the glass can be applied to bevel the glass on the grinder wheel.

The apparatus also has a lustering wheel and a polishing wheel, which are driven by a second motor. The lustering and polishing wheels are perpendicular to and below the grinder wheel, and are not adjacent to any work surface, planar or not. In other words, the glass material cannot be applied to any planar surface when these wheels are used.

The apparatus does not have a multi-tiered work surface and a grinder/planar wheel assembly. These elements allow an individual to obtain greater precision of the glass without losing additional work space on the limited space available for such home improvement apparatuses. This apparatus does not have an internal fluid container or hose to release the fluid upon the glass and/or grinding wheel. The present invention solves this problem and many more.

SUMMARY OF THE INVENTION

A planar/grinding apparatus comprising a housing, a cylindrical member and a motor is the present invention. The housing has a first planar working surface at a first elevation, a second planar working surface at a second elevation which is greater than the first elevation, and at least one aperture positioned in the first and second planar working surfaces. The cylindrical member projects through the aperture and has at least two abrasive surfaces thereon. The first abrasive surface extends from a third elevation, at least equal to or below the first elevation, to a fourth elevation, above the first elevation and below the second elevation. The second abrasive surface extends from a fifth elevation, at least equal to or below the second elevation and above the fourth elevation, to the sixth elevation, above the second elevation. And the motor rotates the cylindrical member.

DETAILED DESCRIPTION OF THE PRESENT INVENTION

Figure 1:
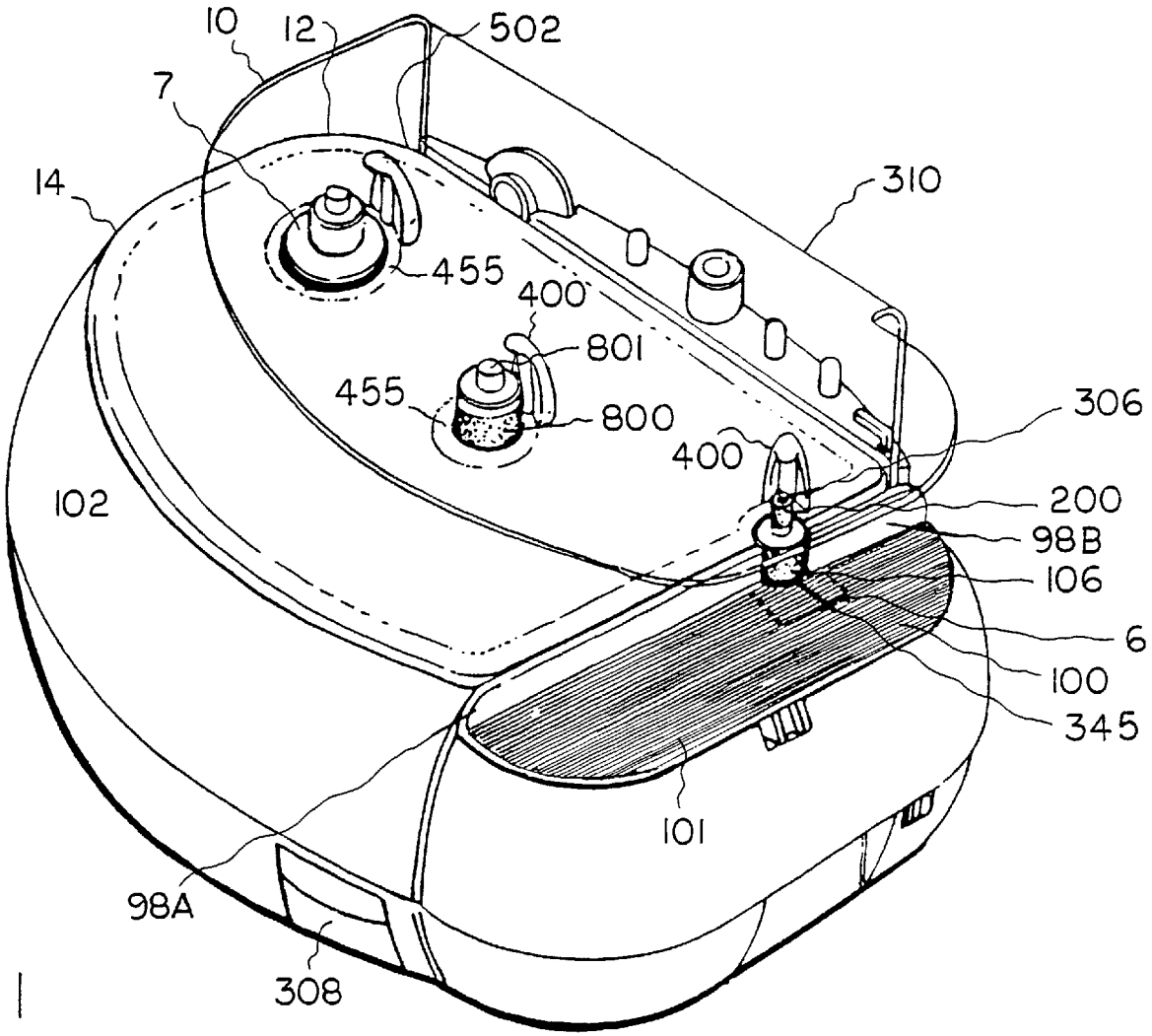
FIG. 1 is a perspective view of the apparatus.

FIG. 1 shows a preferred embodiment of a multi-purpose grinding machine 10. The machine 10 includes a housing 12. And on the exterior of the housing 12 is a cylindrical member 200, at least one spindle 306, a medium tank drawer 308, and an aperture 106 which cylindrical member 200 protrudes there through. The device 10 may also include secondary grinding bits 800 and corresponding shanks 801, and a shield 310. The machine also has a medium dispenser 400 positioned next to each cylindrical member 200 and secondary grinding bit(s) 800.

Figure 6A:
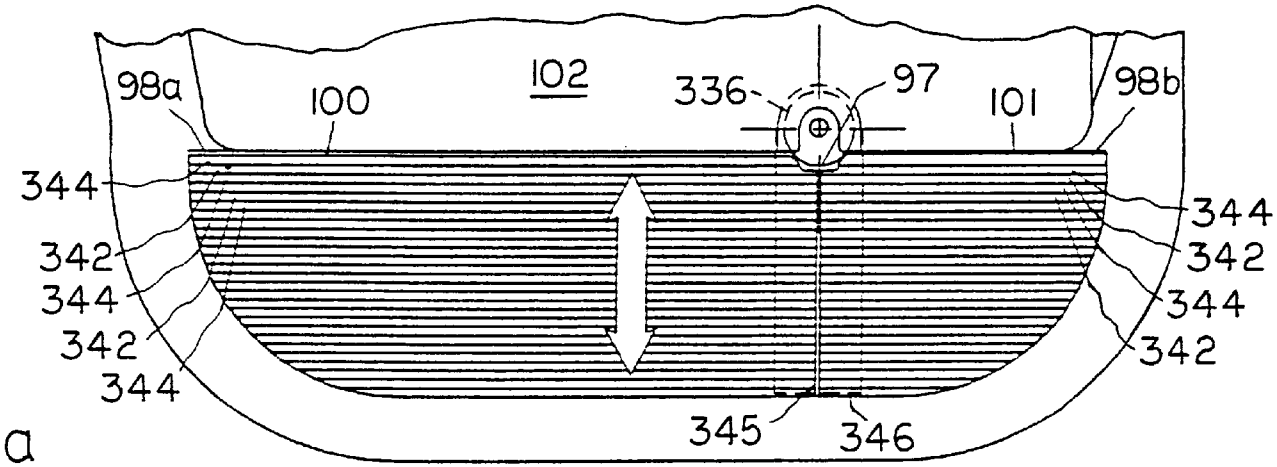
FIG. 6*a* is a top view of FIG. 1 taken from box 6.

The housing 12 has a top 14. Top 14 is divided into at least three sections, a first slidable, planar working surface 100 at a first elevation A, a second fixed, planar working surface 101 at the first elevation A, and a third fixed, planar working surface 102 at a second elevation B, which has a greater elevation than the first elevation A relative to the ground. And at least one aperture 106 positioned in (See FIG. 3) or between (FIGS. 1 and 2) the first, second, and third planar working surfaces 100, 101, 102. Turning to FIG. 6*a*, the first and second working surfaces 100, each has a ledge 98*a*, 98*b*, respectively, which supports a material being planarized. The first slidable, planar working surface 100 also slides back and forth, as shown by the arrows, in relation to the third working surface 102 which increases or decreases the size of a gap area 99. In contrast, the second working surface 101 is fixed so that the ledge 98*b* is tangential to the part of the cylindrical member that extends the furthest into the first and second working surfaces 100, 101 (point 97).

Figure 2:
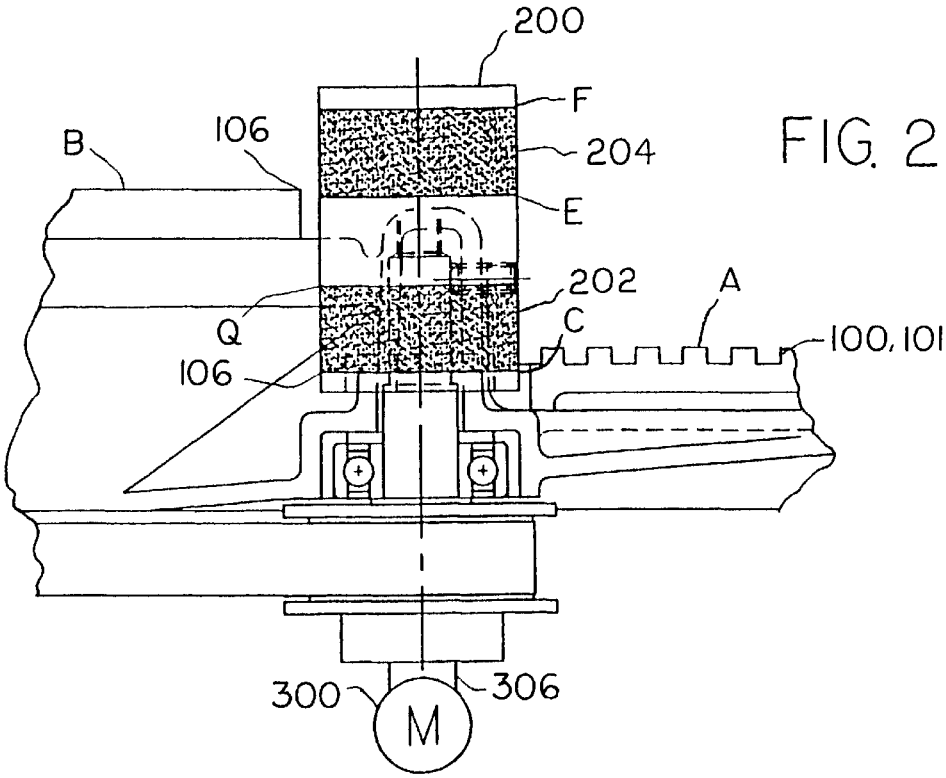
FIG. 2 is cross-sectional view of FIG. 1 from lines 2—2.
Figure 3:
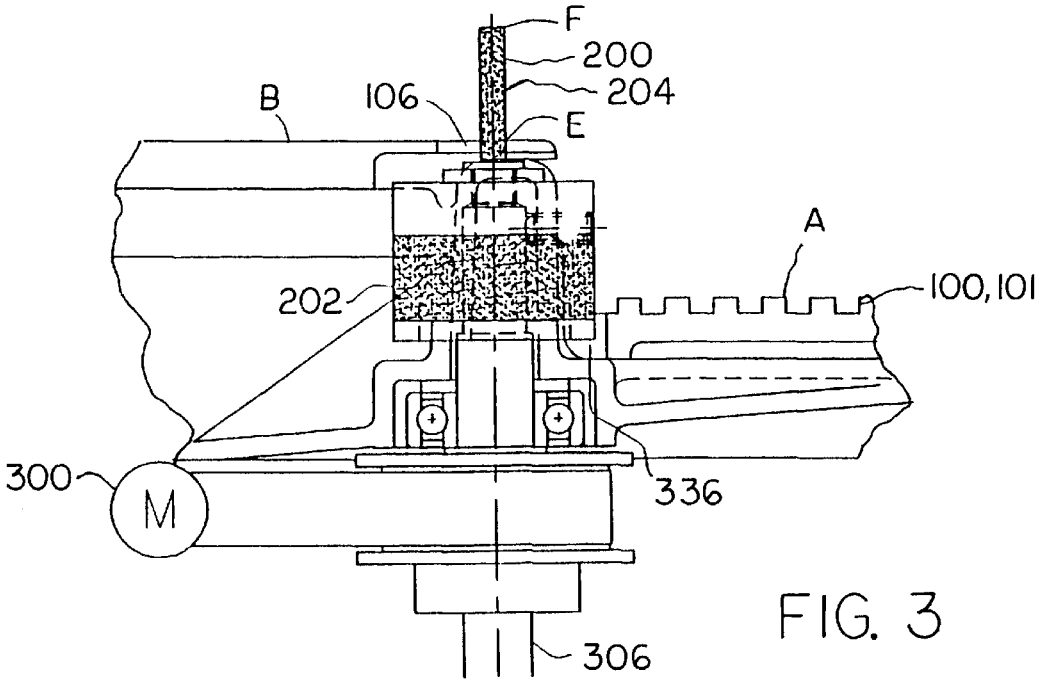
FIG. 3 is an alternative embodiment of FIG. 2.

Turning to FIGS. 2 and 3, the cylindrical member 200 projects through the aperture 106 and has at least two abrasive surfaces thereon 202, 204. The first abrasive surface 202 extends from a third elevation C, at least equal to or below the first elevation A, to a fourth elevation Q, above the first elevation A and below the second elevation B. The second abrasive surface 204 extends from a fifth elevation E, at least equal to or below the second elevation B and above the fourth elevation Q, to the sixth elevation F, above the second elevation B. In FIGS. 1–3, the two abrasive surfaces 202, 204 are an integral part of the cylindrical member 200. Preferably, each abrasive surface 202, 204 provides a distinct abrasiveness to accomplish at least planarizing or grinding. Both planarizing and grinding are distinct abrasiveness characteristics known to those skilled in the art.

The cylindrical member 200 can have one diameter, as shown in FIG. 2, or multiple diameters as shown in FIG. 3. Obviously, the aperture 106 can be altered to conform to the dimension of the first and second abrasive surfaces 202, 204. In one embodiment, the cylindrical member 200 is a single unit as shown in FIG. 2, or two separate units that are mated together by conventional means, like a screw, as shown in FIG. 3.

Figure 4:
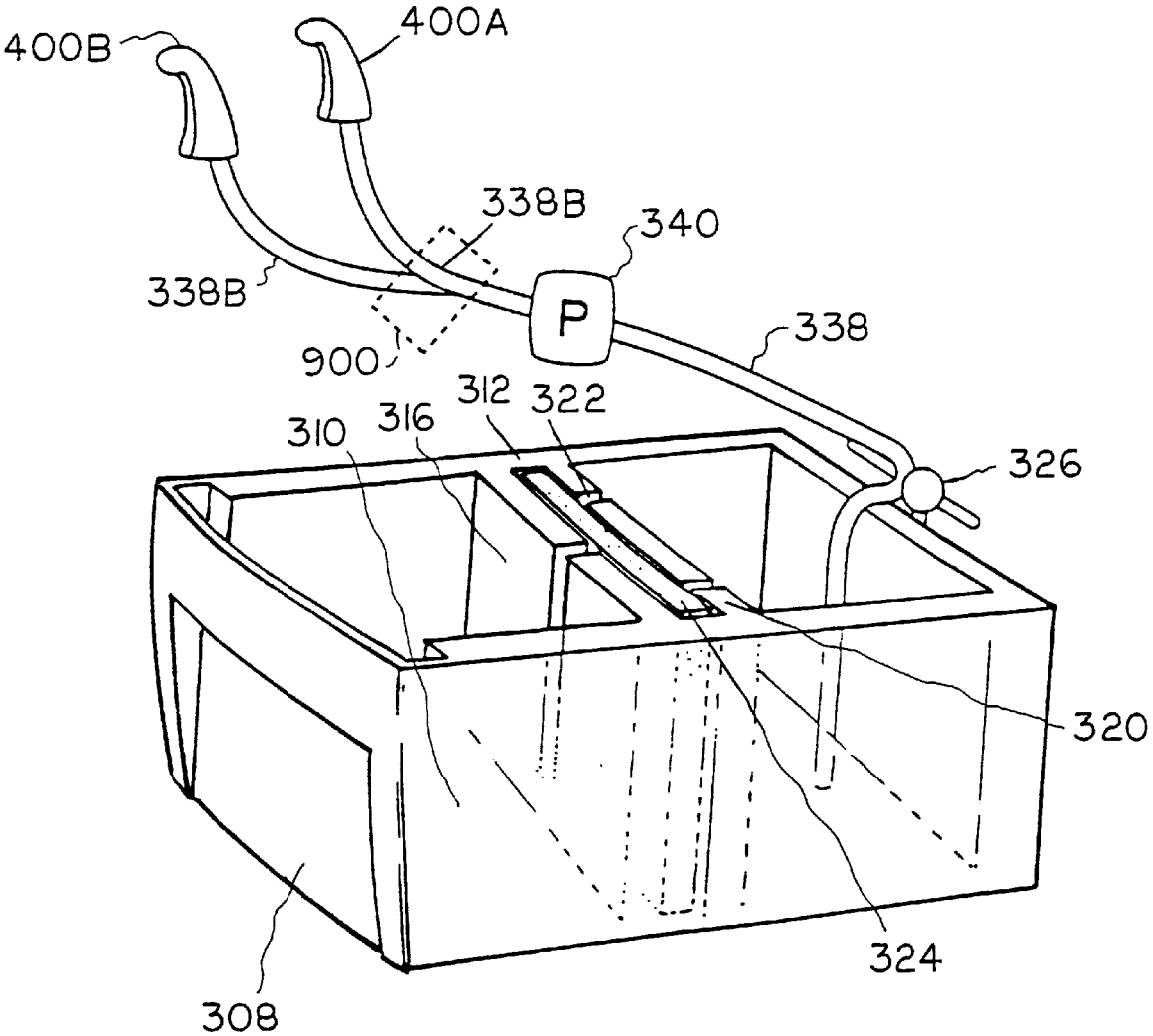
FIG. 4 is schematic of the medium dispensing system.

Turning to FIG. 4, the medium dispenser 400 sprays a medium, air or liquid, onto the material which is being grinded or planarized, and the abrasive surfaces 202, 204, and/or 800. The dispenser 400 receives the medium from the medium tank drawer 308. The medium tank drawer 308 is divided into three chambers: a collection chamber 310, a filter chamber 312, and a dispensing chamber 314. The filter chamber 312 is separated from the collection chamber 310 by a first wall 316 that has an aperture 318. And the filter chamber 312 is separated from the dispensing chamber 314 by a second wall 320 that has an aperture 322. Within the filter chamber 312 is a conventional filtration pad 324 that collects undesired particles and materials from the medium.

Figure 5A:
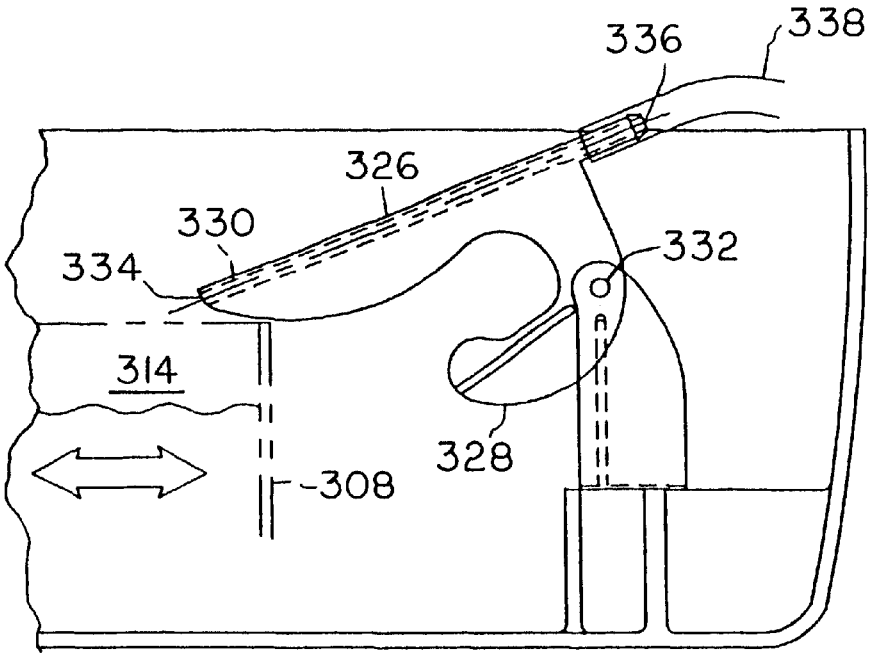
FIG. 5*a* is a schematic view of a medium tank drawer being inserted or withdrawn from the medium dispensing system.
Figure 5B:
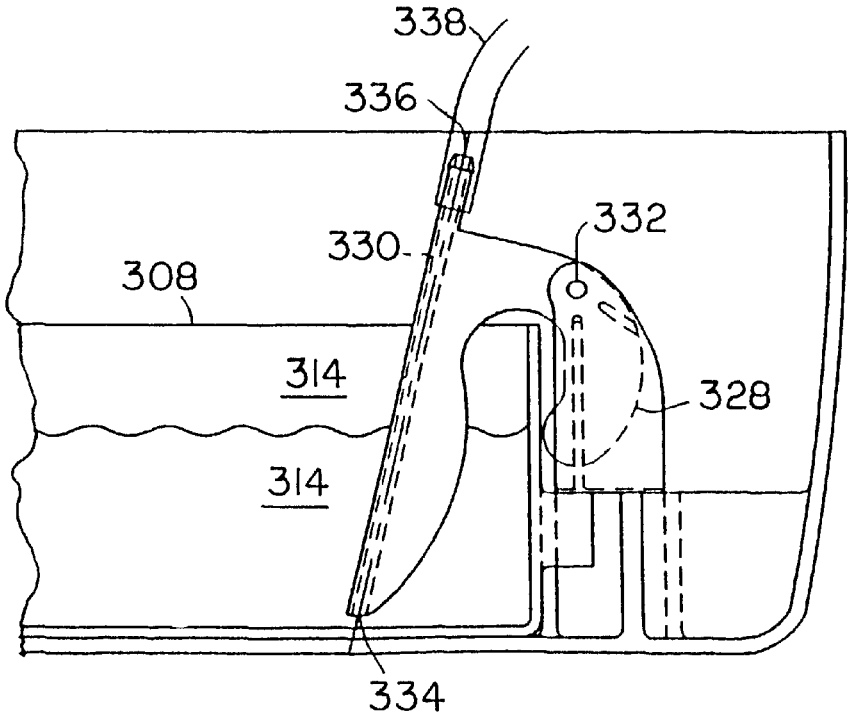
FIG. 5*b* is a schematic view of a medium tank drawer properly positioned in the medium dispensing system.

The medium, if it is a liquid, is initially inserted into the dispensing chamber 314 and then the medium tank drawer 308 is properly positioned into the apparatus 10 by sliding it. When properly positioned, the medium tank drawer 308 contacts a cam-operating tube 326. Turning to FIG. 5*a*, the cam-operated tube 326 has a prong 328, a hollow cylinder 330, and a pivot point 332. The hollow cylinder 330 is positioned almost 90 degrees relative to the prong 328 and has a receiving end 334 that receives the medium from the medium tank drawer 308 and a delivery end 336 that delivers the medium to a tube 338. The pivot point 332 allows the cam-operated tube 326 to pivot about a fulcrum (like a metal tube), not shown. When the drawer 308 is slid (as shown by the arrows) the drawer 308 contacts the prong 328, and pushes the prong 328. When the prong 328 is pushed, the drawer 308, the dispensing chamber 314, and the cam-operated tube 326 are properly positioned to operate within the dispensing system as shown in FIG. 5*b*.

Reverting to FIG. 4, the medium is drawn into the receiving end 336 by creating a negative pressure within the tube 338 and the hollow cylinder 330. The negative pressure is created by a conventional pump 340. The conventional pump 340, can be driven by its own motor (not shown) or by a motor that drives the spindle 306 and/or corresponding shanks 801. The conventional pump 340 draws the medium into the hollow cylinder 330, into the tube 338, and then into a tube 338*b*. From tube 338*b*, the medium is directed to each medium dispenser 400*a* and 400*b* or controlled by a conventional manifold unit 900 that distributes the medium to each dispenser 400*a* and 400*b* or only to particular dispenser (s) 400*a* and/or 400*b*.

Figure 6B:
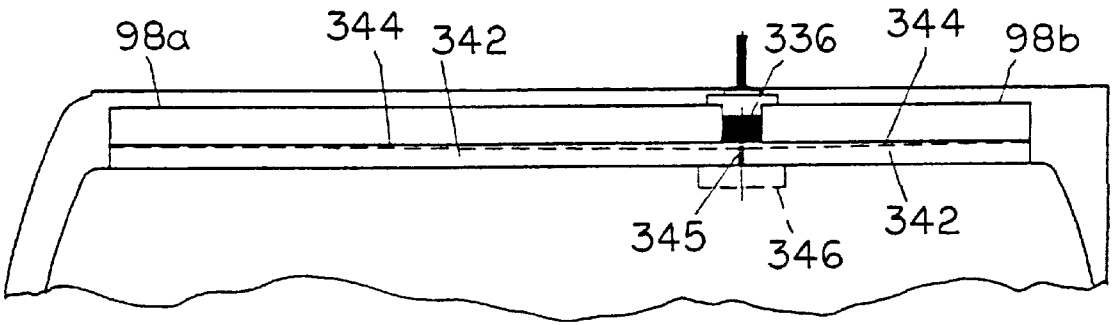
FIG. 6*b* is a cross-sectional view of FIG. 6*a* taken along the lines 6*b*—6*b*.

If the medium is a liquid, the medium must be removed from the top surface 14. Otherwise the medium may damage the material being grinded or planarized. To remove the medium from the top surface 14, each top surface 14 has a design that ensures the medium is removed. FIG. 6*a* illustrates a top view of the first and second working surfaces 100, 101 taken from FIG. 1—box 6 and FIG. 6*b* illustrates a cross-sectional view of FIG. 6*a* taken along the lines 6*b*—6*b*. As shown, these working surfaces 100, 101 have at least two sets of grooves: an inclined groove 342, and a planar groove 344. The planar groove 344 ensures the material being grinded or planarized is on a planar surface, and the inclined groove 342 ensures the medium from the medium dispenser 400 is collected and removed from the working surfaces 100, 102. The inclined groove 342 directs the medium into a space gap 345, which in turn directs the medium into an inclined trough 346.

Figure 7:
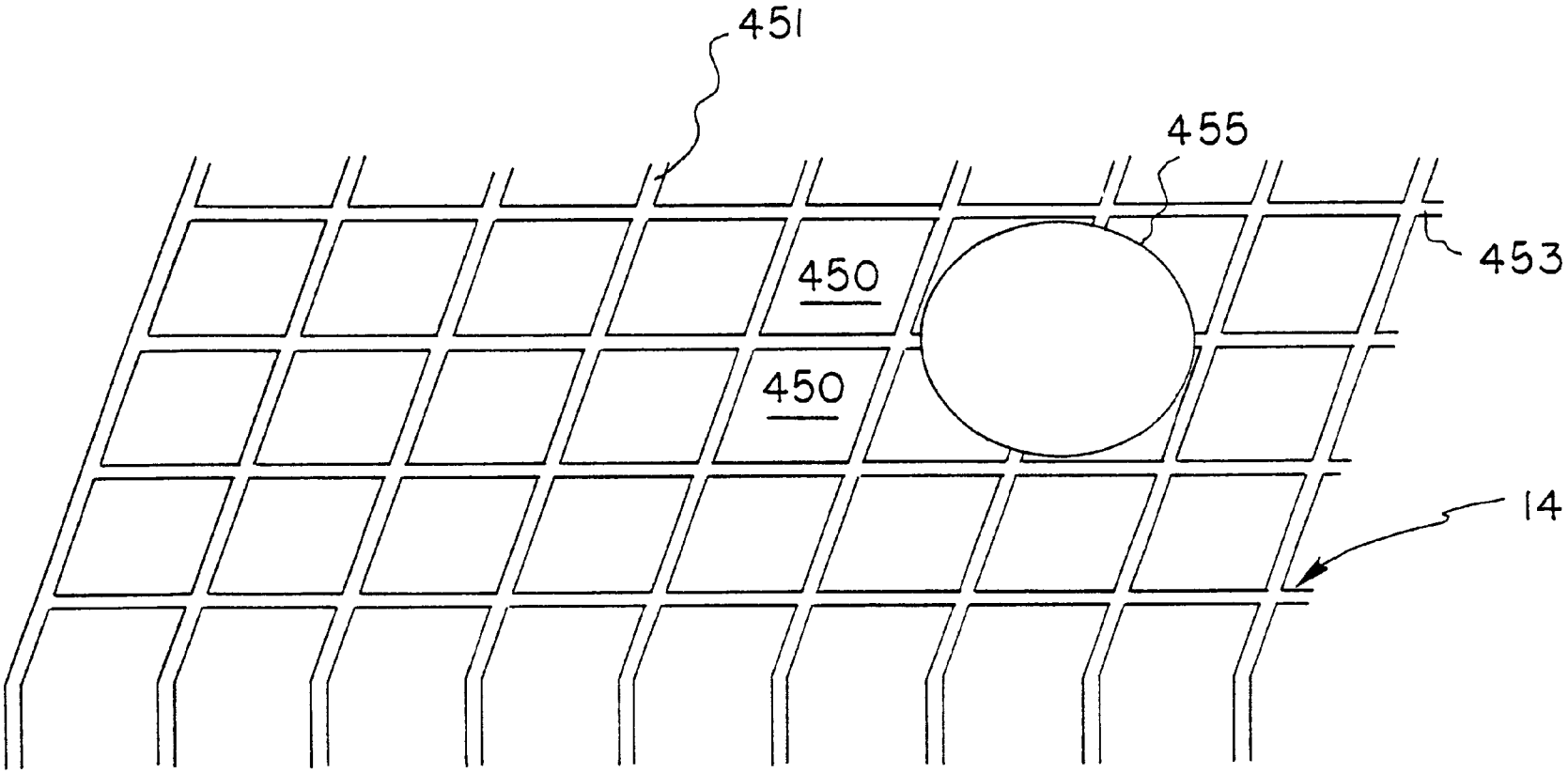
FIG. 7 is schematic view of FIG. 1 taken from box 7.

FIG. 7 illustrates a top view of the third working surface taken from FIG. 1 along box 7, which illustrates that the third working surface 102 is a lattice structure of conventional materials 451, 453 in conventional lattice formats wherein the top surface 14 is planar and interspaced throughout the lattice materials 451, 453 are shank aperture (s) 455 that allow corresponding shanks 801 to penetrate there through and lattice holes 450. The lattice holes 450 allow the medium if it is a liquid-like substance to fall through them.

Figure 8:
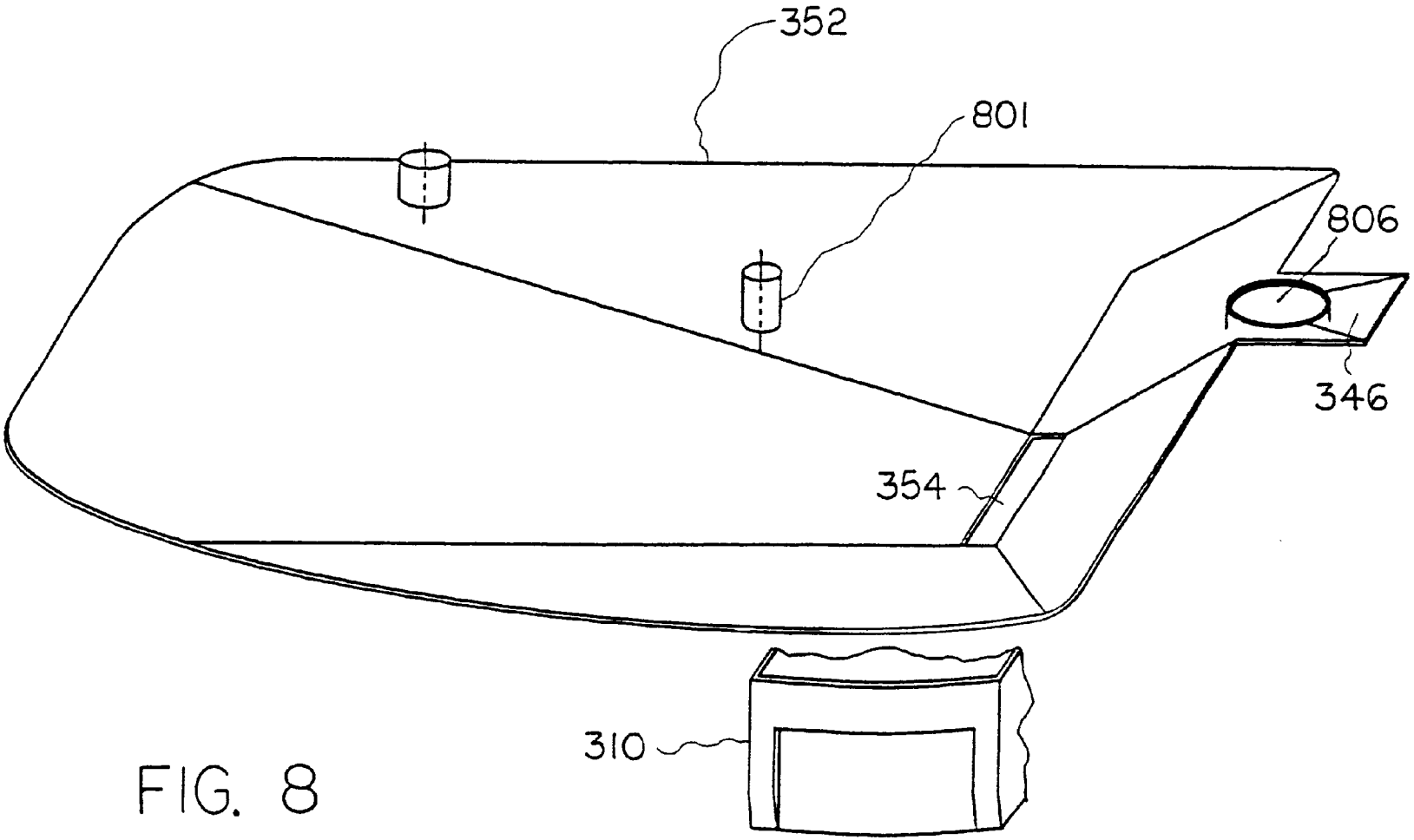
FIG. 8 is a schematic view of the recycling system.

When the medium is collected in the inclined trough 346 and/or falls through the lattice holes 450, the medium, if it is a liquid-like substance, is directed to a receiving trough 352, which is positioned immediately below the third working surface 102. The receiving trough 352, and inclined trough 346 are illustrated in FIG. 8. And from FIG. 8, it shows that the medium goes into the trough aperture 354, which directs the medium into the collection chamber 310.

Reverting to FIG. 4, once the medium enters the collecting chamber 310, the medium passes through aperture 318, filter 324, and aperture 322 into dispensing chamber 314. Thereby, the medium is filtered and the medium is recycled.

The spindle 308 and the other corresponding shanks 801 are rotated by at least one motor 300. Motor 300 is a conventional motor that rotates the spindle 308, shanks 801, the cylindrical member 200, and the other bits 800. The motor 300 can be directly connected to spindle 308, as shown in FIG. 2, or indirectly through conventional means, as shown in FIG. 3. The motor 300 receives its power from an outside power source, like an electrical outlet (not shown). Moreover, a conventional electrical switch (not shown) controls whether any electrical power is received by the motor 300.

Figure 9:
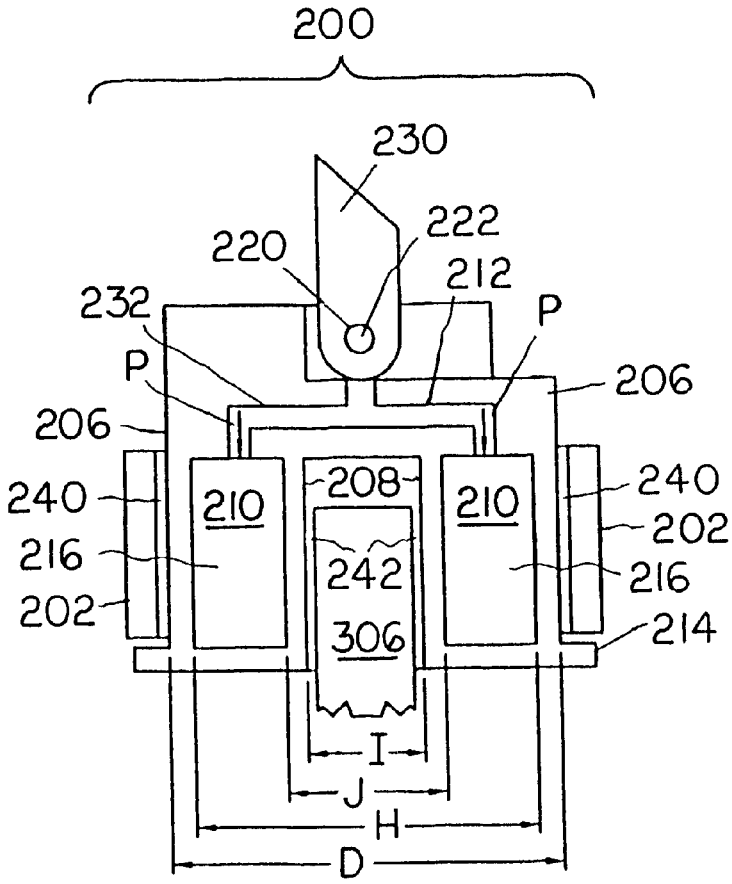
FIG. 9 is an alternative embodiment of the cylindrical member.

Turning to FIG. 9, the present invention also relates to an embodiment of the cylindrical member 200 having an expansion capabilities for supporting grinding/planarizing sleeves 202, 204. For purposes of this presentation, we are illustrating only the grinding sleeve 202 and not the sleeve 204 for ease of discussion. Obviously, this application is applied to both sleeves when the cylindrical member is a single unit, as shown in FIG. 2. Returning to FIG. 9, the cylindrical member 200 has an outer surface 206, an interior chamber 208, an expanding chamber 210, and a locking mechanism 212.

The outer surface 206 receives the grinding sleeve 202. The outer surface 206 has a first outer diameter of D that receives the sleeve 202 and a ledge 214 to ensure the sleeve 202 does not fall off the device 200.

The interior chamber 208 receives the rotatable shaft 306. The chamber 208 has an outer diameter of I, which is less than D. The outer surface 206 and interior chamber 208 are made of materials that expand when a pressure is applied to them. Examples of these expandable materials include plastic and certain alloys known to those skilled in the art.

The expanding chamber 210 comprises an expanding material 216 that expands and contracts based upon pressure applied thereon. Examples of the expanding material 216 include, and not limited to, water, rubber, polyethylene and other known expandable polymers water-based solutions and oil-based solutions. The chamber 210 has an outer diameter of H and an inner diameter of J, wherein H and J are both greater than I and less than D.

Figure 10:
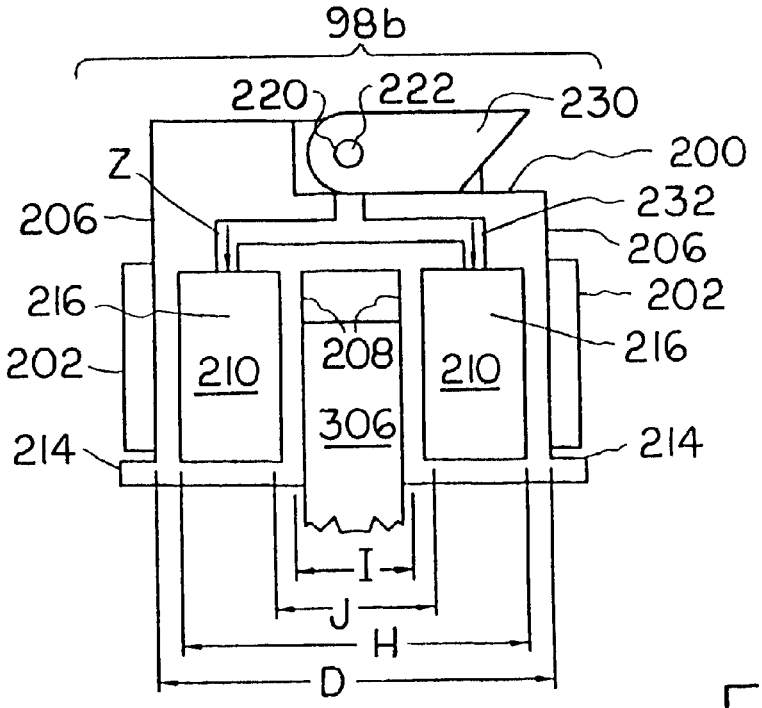
FIG. 10 is an alternative embodiment of FIG. 9.

The locking mechanism 212 has an open position, as shown in FIG. 9, and a closed position, as shown in FIG. 10, and requires no hand tool to alter between the two positions. The locking mechanism 212 has two components, an upper component 230 and a lower component 232. The upper component 230, in one embodiment, is a locking lever with a cam actuator with a locking detent that rotates about pivot point 220. Pivot point 220 has a securing mechanism 222, such as a bolt pin, a rivet, or a screw, that secures the locking mechanism 212 to the device 200 and allows the upper component 230 to rotate about the pivot point 220 into the open or closed position.

When the locking mechanism 212 is in the open position, the lower portion 232, an internal plunger, applies a pressure P to the expanding material 216. In the open position, the outer diameter of the outer surface 206 is D, the outer diameter of the interior chamber 208 is I, the outer diameter of the expanding chamber is H, and the inner diameter of the expanding chamber is J. With those diameters, the device 200 receives the grinding sleeves (202 and obviously 204) since there is a first gap 240 between the sleeve 202 and the outer surface 206, and the rotatable shaft 306 receives the device 200 since there is a second gap 242 between the outer diameter of the interior chamber 208 and shaft 306.

The grinding sleeve 202 (and 204) can be sandpaper, diamond, emery cloth or any conventional material that grinds metal, wood, or plastic materials. The grinding sleeve 202 (and 204) is cylindrical or any other shape that fits upon one size of device 200.

Turning to FIG. 10, when the locking mechanism 212 is in the closed position the lower component 232 applies a pressure Z, which is greater than P, to compress the expanding material 216. In the closed position, the compressed expanding material 216 forces the outer diameter of the outer surface 206 and the outer diameter of the expanding chamber 210 to expand in order to secure the grinding sleeve 202 to the outer surface 206 with little to no gap 240. The expanding material 216 in the closed position also forces the outer diameter of the interior chamber and inner diameter of the expanding chamber to contract in order to secure the cylindrical member 200 to the rotating shaft 306 with little to no gap 242.

The device 10 also includes, optionally, a splash guard 310, which may slide within a second aperture 502 on the top 14, a utility drawer (not shown) on the side of the housing 12, a third aperture 506 on the top surface 14 which allows an eye shield (not shown) or a light (not shown) or extra grinding or planarizing bits (not shown) to be placed on the housing 12, and a lever 508 to lock the first slidable, planar working surface 100 in position. These additional elements are optional, and increase the adaptability of the present invention over other devices.

Numerous variations will occur to those skilled in the art. It is intended therefore, that the foregoing descriptions be only illustrative of the present invention and that the present invention be limited only by the hereinafter appended claims.

We claim:

1. A planar/grinding apparatus comprising:

a housing having a first slidable, planar working surface at a first elevation, a second fixed, planar working surface at a second elevation which is at a greater elevation in relation to the apparatus than the first elevation, and at least one aperture positioned between the first and second planar working surfaces;

a cylindrical member projecting through the aperture and having at least two abrasive surfaces thereon, the first abrasive surface extends from a third elevation, at least equal to or below the first elevation, to a fourth elevation, above the first elevation and below the second elevation, and the second abrasive surface extends from a fifth elevation, at least equal to or below the second elevation and above the fourth elevation, to the sixth elevation, above the second elevation; and a motor which rotates the cylindrical member.

2. The apparatus of claim 1 wherein the cylindrical member is multi-tiered.

3. The apparatus of claim 1 wherein the cylindrical member has one diameter.

4. The apparatus of claim 1 wherein the first and second abrasive surfaces are components of the cylindrical member.

5. The apparatus of claim 1 wherein the first abrasive surface is an abrasive sleeve.

6. The apparatus of claim 5 wherein the cylindrical member expands to retain the abrasive sleeve.

7. The apparatus of claim 1 wherein the second abrasive surface is an abrasive sleeve.

8. The apparatus of claim 7 wherein the cylindrical member expands to retain the abrasive sleeve.

9. The apparatus of claim 1 further comprising a medium dispenser unit which applies a predetermined medium onto the cylindrical member.

10. The apparatus of claim 9 further comprising a system that recycles the predetermined medium.

11. The apparatus of claim 10 wherein the recycling system has a filtration system.

12. The apparatus of claim 9 wherein the medium dispenser unit receives the predetermined medium from a medium reservoir through a dispensing system having a cam-operated tube.

13. A planar/grinding apparatus comprising:

a housing having a first slidable, planar working surface at a first elevation, a second fixed, planar working surface at a second elevation which is greater than the first elevation, and at least one aperture positioned in the first and second planar working surfaces;

a cylindrical member projecting through the aperture and having at least two abrasive surfaces thereon, the first abrasive surface extends from a third elevation, at least equal to or below the first elevation, to a fourth elevation, above the first elevation and below the second elevation, and the second abrasive surface extends from a fifth elevation, at least equal to or below the second elevation and above the fourth elevation, to the sixth elevation, above the second elevation; and a motor which rotates the cylindrical member.

14. The apparatus of claim 13 wherein the cylindrical member is multi-tiered.

15. The apparatus of claim 13 wherein the cylindrical member has one diameter.

16. The apparatus of claim 13 wherein the first and second abrasive surfaces are components of the cylindrical member.

17. The apparatus of claim 13 wherein the first abrasive surface is an abrasive sleeve.

18. The apparatus of claim 17 wherein the cylindrical member expands to retain the abrasive sleeve.

19. The apparatus of claim 13 wherein the second abrasive surface is an abrasive sleeve.

20. The apparatus of claim 19 wherein the cylindrical member expands to retain the abrasive sleeve.

21. The apparatus of claim 13 further comprising a medium dispenser unit which applies a predetermined medium onto at least a material being grinded or planarized.

22. The apparatus of claim 13 further comprising a system that recycles the predetermined medium.

23. The apparatus of claim 22 wherein the recycling system has a filtration system.

24. The apparatus of claim 21 wherein the medium dispenser unit receives the predetermined medium from a medium reservoir through a dispensing system having a cam-operated tube.

25. A method of using a planar/grinding apparatus comprising the steps of:

placing a material onto the apparatus comprising:

a housing having a first slidable, planar working surface at a first elevation, a second fixed, planar working surface at a second elevation which is greater than the first elevation, and at least one aperture positioned in the first and second planar working surfaces;

a cylindrical member projecting through the aperture and having at least two abrasive surfaces thereon, the first abrasive surface extends from a third elevation, at least equal to or below the first elevation, to a fourth elevation, above the first elevation and below the second elevation, and the second abrasive surface extends from a fifth elevation, at least equal to or below the second elevation and above the fourth elevation, to the sixth elevation, above the second elevation; and a motor which rotates the cylindrical member; and grinding the material to a desired shape.

* * * * *